US011992120B2

(12) United States Patent
Davis et al.

(10) Patent No.: US 11,992,120 B2
(45) Date of Patent: May 28, 2024

(54) SHELVING UNIT

(71) Applicant: Hercke LLC, Lake Forest, CA (US)

(72) Inventors: Matthew E. Davis, Lake Forest, CA (US); Jeff W. Kuecker, Lake Forest, CA (US); Dylan T. Ritchie, Lake Forest, CA (US)

(73) Assignee: EAGLE INDUSTRIAL GROUP INC., Rancho Santa Margarita, CA (US)

( * ) Notice: Subject to any disclaimer, the term of this patent is extended or adjusted under 35 U.S.C. 154(b) by 0 days.

(21) Appl. No.: 16/259,149

(22) Filed: Jan. 28, 2019

(65) Prior Publication Data

US 2019/0290000 A1 Sep. 26, 2019

Related U.S. Application Data

(63) Continuation of application No. 29/637,331, filed on Feb. 15, 2018, now abandoned.

(Continued)

(51) Int. Cl.

*A47B 57/44* (2006.01)
*A47B 47/02* (2006.01)

(Continued)

(52) U.S. Cl.

CPC ..... *A47B 57/44* (2013.01); *A47B 47/021* (2013.01); *A47B 57/34* (2013.01); *A47B 96/021* (2013.01); *A47F 5/101* (2013.01); *A47F 5/13* (2013.01)

(58) Field of Classification Search

CPC ..... A47B 57/44; A47B 57/50; A47B 47/028; A47B 57/34; A47B 47/021; A47B 96/201; A47F 5/101; A47F 5/13

See application file for complete search history.

(56) References Cited

U.S. PATENT DOCUMENTS 3,351,212 A * 11/1967 McConnell ..... A47B 57/402 211/192
4,645,276 A * 2/1987 Flavigny ..... A47B 57/44 108/107

(Continued)

FOREIGN PATENT DOCUMENTS

DE 2458755 A1 * 6/1976 ..... A47B 57/50
FR 1369373 A * 8/1964 ..... F16B 12/30
GB 897929 A * 5/1962 ..... A47B 57/487

*Primary Examiner* — Stanton L Krycinski

(74) *Attorney, Agent, or Firm* — Thompson Patent Law Offices PC

(57) ABSTRACT

An adjustable free-standing shelving unit with horizontal shelf support beams suitable for holding one or more wire deck panels, which are detachably mounted to vertical corner posts by way of a unique combination of shoulder bolts, attached to the horizontal support beams, and keyhole slots in the vertical corner posts. In some embodiments, shoulder bolts having a head with a wrench receiving surface, an unthreaded shoulder, and a threaded shank are attached to the horizontal support beams using hex nuts. The keyhole slots, which are formed in each of the angled flat sides of the L-shaped vertical corner posts, are sized so that the heads of the shoulder bolts can be inserted into the wide upper openings of the keyhole and then pushed downwardly so that the unthreaded shoulders of the bolts will slide into the low slots.

19 Claims, 10 Drawing Sheets

Related U.S. Application Data

(60) Provisional application No. 62/660,928, filed on Apr. 20, 2018.

(51) Int. Cl.

| | |
|---|---|
| ***A47B 57/34*** | (2006.01) |
| ***A47B 96/02*** | (2006.01) |
| ***A47F 5/10*** | (2006.01) |
| ***A47F 5/13*** | (2006.01) |

(56) References Cited

U.S. PATENT DOCUMENTS 4,665,838 A * 5/1987 Minshall ..... A47B 47/021 108/157.13
4,967,916 A * 11/1990 Handler ..... A47B 57/44 108/188
5,163,568 A * 11/1992 Laurendeau ..... A47B 88/43 211/208
5,263,598 A * 11/1993 Vortherms ..... A47B 57/44 211/189
5,411,154 A * 5/1995 Vargo ..... F16B 12/30 211/189
5,463,966 A * 11/1995 Nilsson ..... F16B 12/34 108/110
5,624,045 A * 4/1997 Highsmith ..... A47B 57/487 211/191
5,845,795 A * 12/1998 Mulholland ..... A47B 47/027 211/192
6,352,164 B1 * 3/2002 Hyatte ..... A47B 57/50 211/192
7,128,225 B2 * 10/2006 Saltzburg ..... A47B 57/50 211/187
7,252,202 B2 * 8/2007 Saltzberg ..... A47B 57/50 211/187
8,322,668 B2 * 12/2012 Tang ..... H05K 7/1489 211/175
8,424,694 B2 * 4/2013 Eustace ..... A47B 57/50 211/192
8,443,992 B2 * 5/2013 Lawson ..... A47B 47/028 211/187
8,672,150 B2 * 3/2014 Chen ..... A47B 57/50 108/147.16
8,733,564 B2 * 5/2014 Fitzgerald ..... A47B 57/50 211/191
8,844,211 B2 * 9/2014 Pensi ..... A47B 96/1466 52/36.6
9,027,767 B2 * 5/2015 Buckley ..... A47F 5/00 211/134
9,215,926 B1 * 12/2015 Offerman ..... A47B 47/02
9,215,931 B1 * 12/2015 Offerman ..... A47B 96/024
9,241,566 B1 * 1/2016 Chen ..... A47B 57/38
9,301,610 B1 * 4/2016 Berry ..... A47B 96/1416
9,386,855 B2 * 7/2016 Sabounjian ..... A47B 96/14
9,629,455 B2 * 4/2017 Shah ..... A47F 5/0892
9,713,379 B1 * 7/2017 Tsai ..... A47B 96/06
9,723,925 B1 * 8/2017 Tsai ..... A47B 47/0083
9,877,600 B1 * 1/2018 Lin ..... A47B 5/00
9,961,995 B2 * 5/2018 Kam ..... A47B 57/485
10,098,458 B2 * 10/2018 Lindmark ..... A47B 96/02
10,299,594 B2 * 5/2019 Liss ..... A47B 47/027
2012/0000873 A1 * 1/2012 Fitzgerald ..... A47B 57/50 211/153
2015/0282613 A1 * 10/2015 Chen ..... A47B 96/021 211/187
2015/0313357 A1 * 11/2015 David ..... A47B 47/0083 211/187
2016/0051044 A1 * 2/2016 Sabounjian ..... A47B 47/021 211/186
2017/0347793 A1 * 12/2017 Wang ..... A47B 47/025
2019/0125077 A1 * 5/2019 Liss ..... A47B 47/021
2019/0328134 A1 * 10/2019 Walker ..... A47B 96/1441

* cited by examiner

SHELVING UNIT

The present application claims priority from U.S. Provisional Patent Application No. 62/660,928, filed Apr. 20, 2018, entitled "SHELVING UNIT" by Matthew E. DAVIS et al., and from U.S. patent application Ser. No. 29/637,331, filed Feb. 15, 2018, entitled "SHELVING UNIT" by Matthew E. DAVIS et al., both of which are incorporated by reference herein in their entirety.

TECHNICAL FIELD OF THE INVENTION

The invention relates generally to shelving units used for storage, and more particularly to storage racks that can be easily assembled but that are also strong and secure enough for commercial use or for heavy-duty consumer applications.

BACKGROUND OF THE INVENTION

Adjustable steel shelving units are widely used in homes and offices for consumer purposes and for commercial and industrial applications. The typical shelving system includes a set of four corner posts which stand vertically upright. Shelf support beams are connected horizontally between each adjacent pair of vertical corner posts to form rectangular frames at varying heights. Each of the shelf frames can support a flat shelf or deck on which various items can be supported and stored.

Many prior art shelving systems require the use of bolts or other fasteners to directly attach the support beams to the vertical posts. Typically, the bolts are inserted through corresponding holes in the support beams and in the vertical posts and secured by washers and nuts on the inward facing sides of the vertical posts. Such systems can be difficult and time-consuming to assemble, particularly for one person, because the beams and frames must be held in the proper location while the fasteners are inserted.

Other prior art systems, often referred to as "boltless" systems, use integrally formed rivets or studs on the ends of the support beams. Each of the integrally formed rivets will have a wide head portion attached to the support beam by a narrower shank portion. The vertical posts are formed with vertically spaced keyhole-shaped slots, each slot having a wider upper portion to allow the rivet head to pass through and a lower narrow portion that is wide enough for the rivet shank, but which is not wide enough for the rivet head to pass through. Boltless systems are considered to be easier to assemble and disassemble than shelving systems using separate fasteners or bolts, however such systems also suffer from a number of disadvantages. In order to form a tight fit, the width of the shank must be virtually the same as the thickness of the vertical post. This means that the rivets typically have to be hammered down into place, which makes assembly and disassembly more difficult. And even with such a tight fit, the use of rivets and slots does not hold the shelves in place as securely as the use of separate fasteners that can be tightened even further. Also, manufacturing variations make it much more difficult to reliably form rivets capable of supporting very heavy loads, while the strength and load supporting capabilities of separate bolts or fasteners are more uniform and more easily calculated. For these reasons, boltless shelving is often considered unsuitable for supporting very heavy loads.

What is needed is a shelving unit that overcomes the disadvantages of the prior art.

SUMMARY OF THE INVENTION

Embodiments of the present invention are directed to an adjustable free-standing shelving unit that is easy to assemble, while still being strong and secure enough for commercial use or for heavy-duty consumer applications. The shelving unit has horizontal shelf support beams, which are suitable for holding one or more wire deck panels, and which are mounted to the vertical corner posts of the shelving unit by way of a unique combination of shoulder bolts, attached to the horizontal support beams, and keyhole slots in the vertical corner posts. The combination of shoulder bolts and keyhole slots provides the advantages in load capacity and installation strength of the prior art systems using separate fasteners, while providing an ease of installation that is comparable to boltless shelving units.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF PREFERRED EMBODIMENTS

Embodiments of the present invention are directed to an adjustable free-standing shelving unit that is easy to assemble, while still being strong and secure enough for commercial use or for heavy-duty consumer applications. The shelving unit has horizontal shelf support beams, which are suitable for holding one or more wire deck panels, and which are detachably mounted to the vertical corner posts of the shelving unit by way of a unique combination of shoulder bolts, attached to the horizontal support beams, and keyhole slots in the vertical corner posts. In some embodiments, shoulder bolts having a head with a wrench receiving surface, an unthreaded shoulder, and a threaded shank are attached to the horizontal support beams using hex nuts. The keyhole slots, which are formed in each of the angled flat sides of the L-shaped vertical corner posts, are sized so that the heads of the shoulder bolts can be inserted into the wide upper openings of the keyhole and then pushed downwardly so that the unthreaded shoulders of the bolts will slide into the low slots.

Significantly, once the horizontal beams have been mounted onto the vertical posts in this fashion, the heads of the shoulder bolts can be further tightened using their wrench receiving surfaces to securely hold the horizontal beams in place by way of compressive force applied to the vertical supports. A shelving unit according to embodiments of the present invention thus provides the ease of assembly of a typical boltless shelving system, while also proving the increased strength and security of a bolted shelving system.

Figure 1:
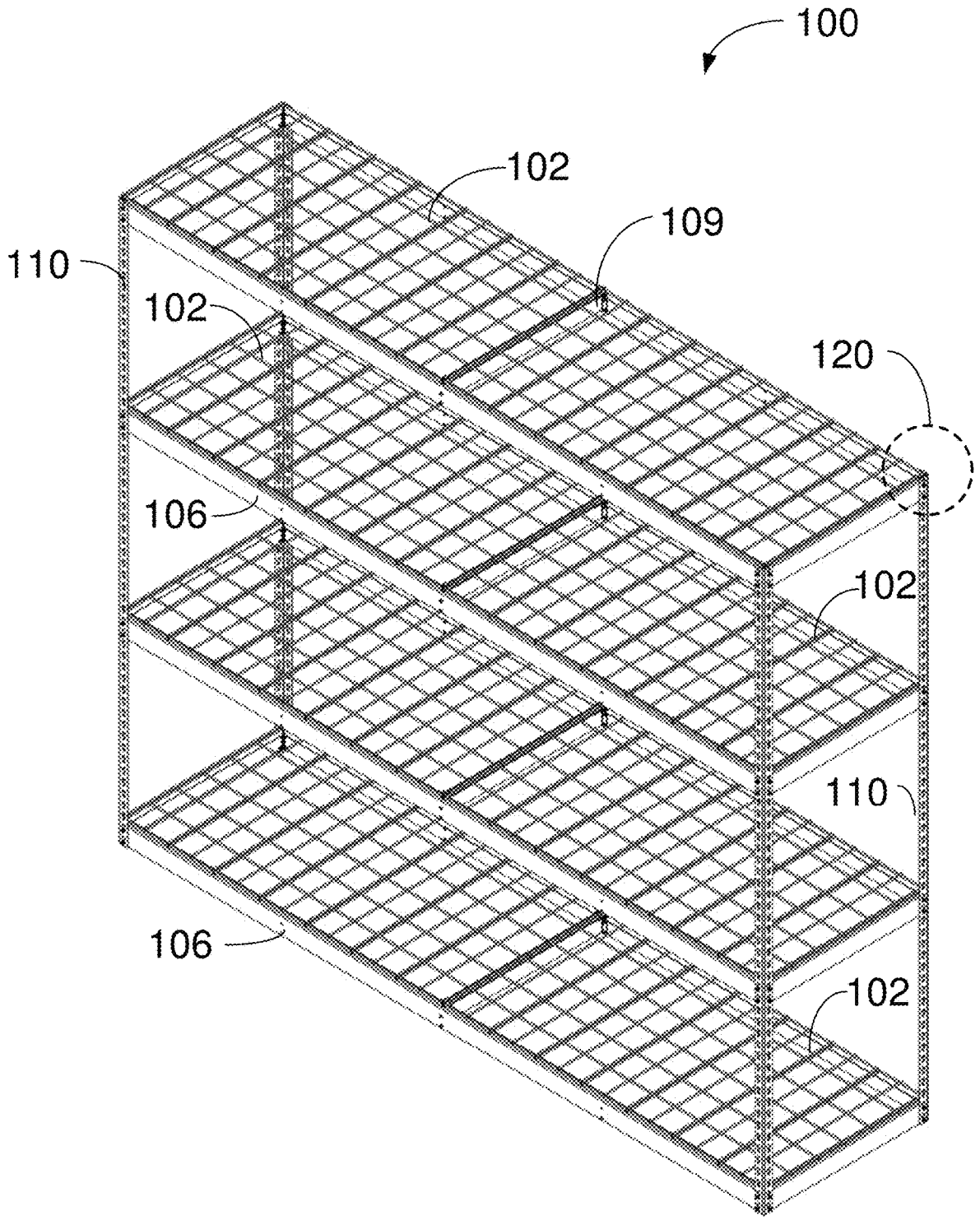
FIG. 1 is a perspective view of a shelving unit according to an embodiment of the invention.
Figure 3:
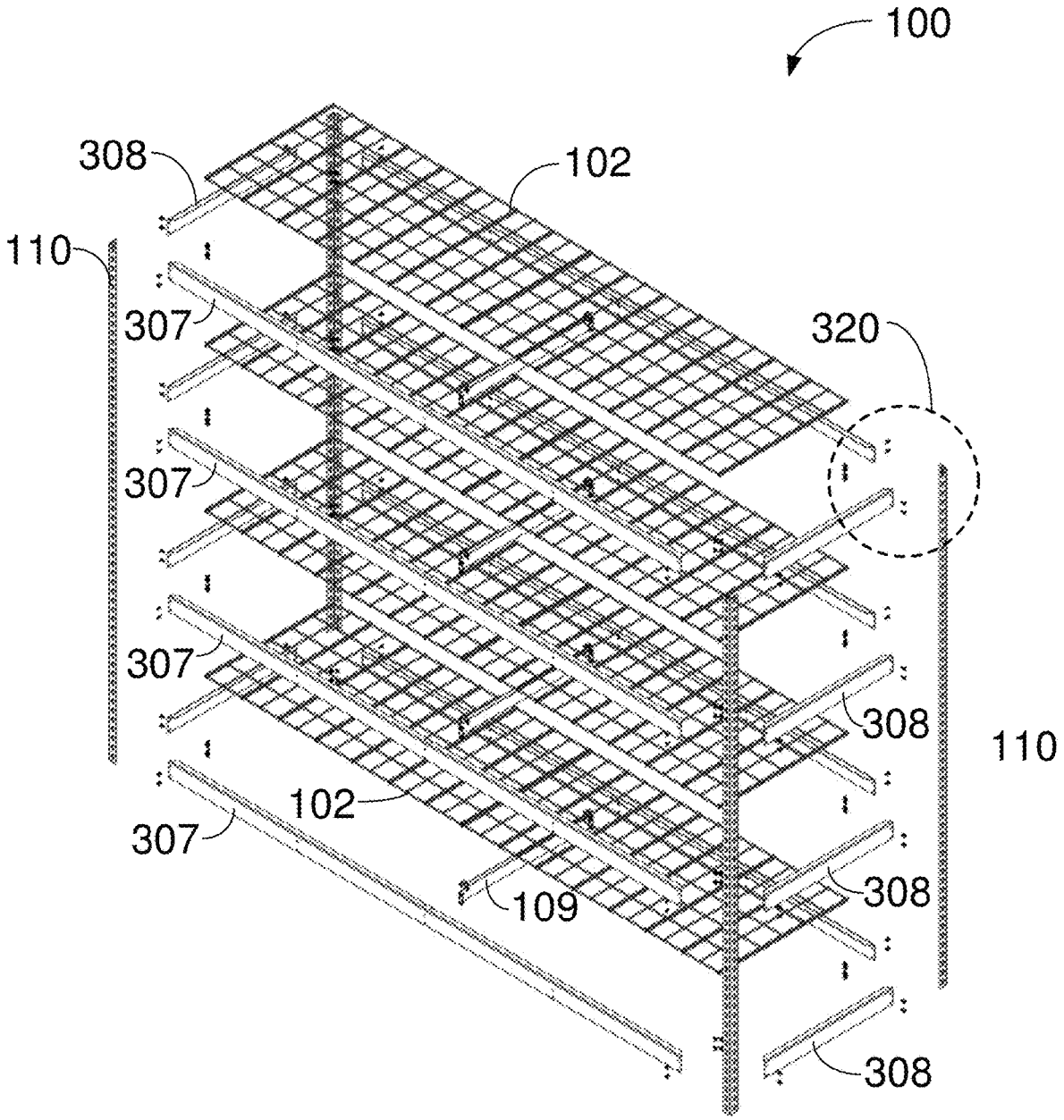
FIG. 3 is an exploded view of the embodiment of FIG. 1.
Figure 8A:
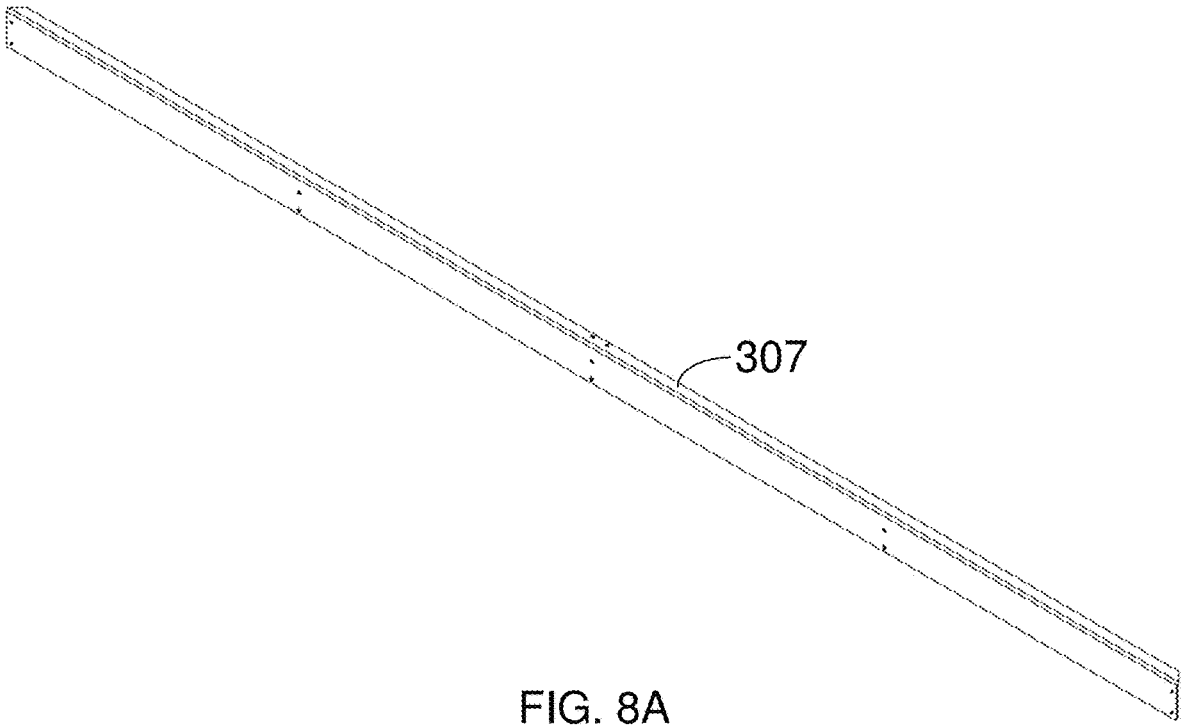
FIG. 8A is a perspective view of a longitudinal support beam according to an embodiment;'
Figure 8C:
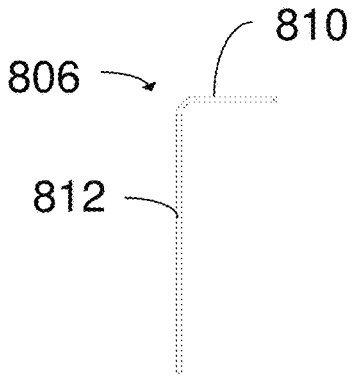
FIG. 8C is a cross sectional view of a support beam according to an embodiment.
Figure 8B:
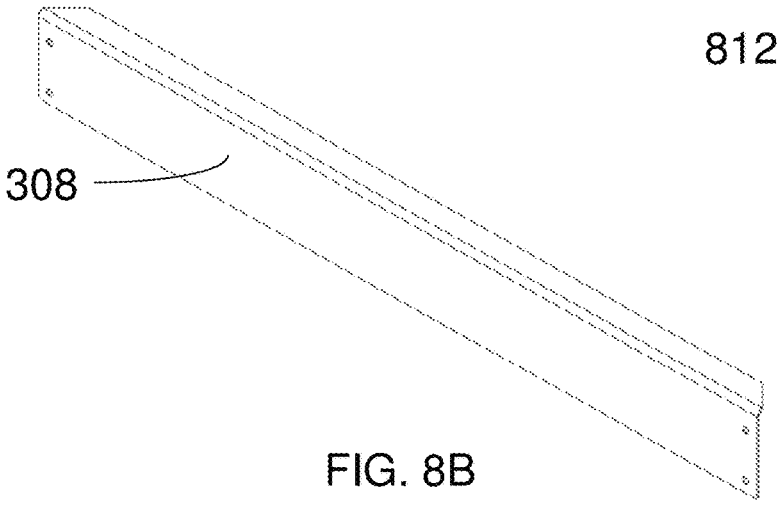
FIG. 8B is a perspective view of a transverse support beam according to an embodiment;'
Figure 9A:
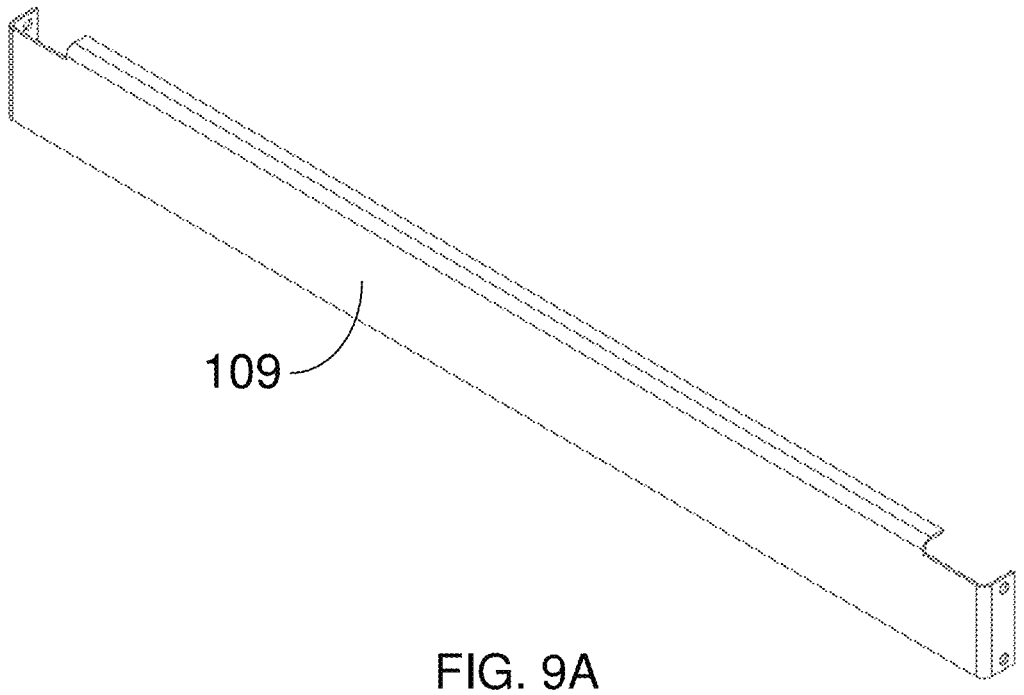
FIG. 9A is a perspective view of a center support beam according to an embodiment.
Figure 9B:
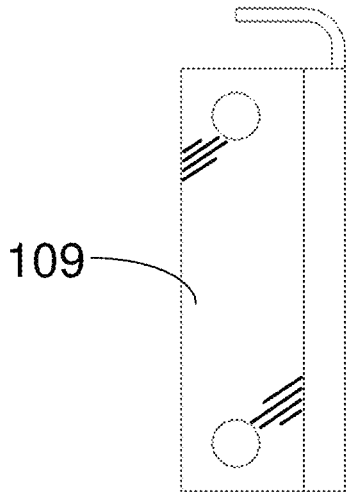
FIG. 9B is a side view of a center support beam according to an embodiment.

Turning now to the drawings, FIG. 1 shows a shelving unit or apparatus 100 according to an embodiment of the invention including a plurality of vertically spaced shelves or decks 102, which can be, for example, a welded wire mesh, as shown, or a solid sheet, such as plywood, metal, or plastic. FIG. 3 is an exploded view of the shelving assembly of FIG. 1. In some embodiments, decks can be formed from two or more deck panels mounted side-by-side. Referring also to FIG. 3, decks 102 are supported by beams 106 that form a rectangular frame using four beams 106, two longitudinal beams 307 (a front beam and a back beam) and two transverse side beams 308. Referring also to FIGS. 8A-C, in some embodiments, the beams forming the frame have a generally L-shaped cross section 806 with a vertical portion 812, which provides the mounting surface for the threaded shoulder bolts described below, and a horizontal portion 810 (which supports the deck) as shown in FIG. 8C. One or more center support beams 109 can be used to provide additional support for deck 102. Beams can be formed from steel or any other appropriate material, with a thickness of at least 20 gauge, such as at least 16 gauge, at least 12 gauge or at least 10 gauge bent to form a member having a generally L-shaped cross-section using conventional machinery.

Figure 2:
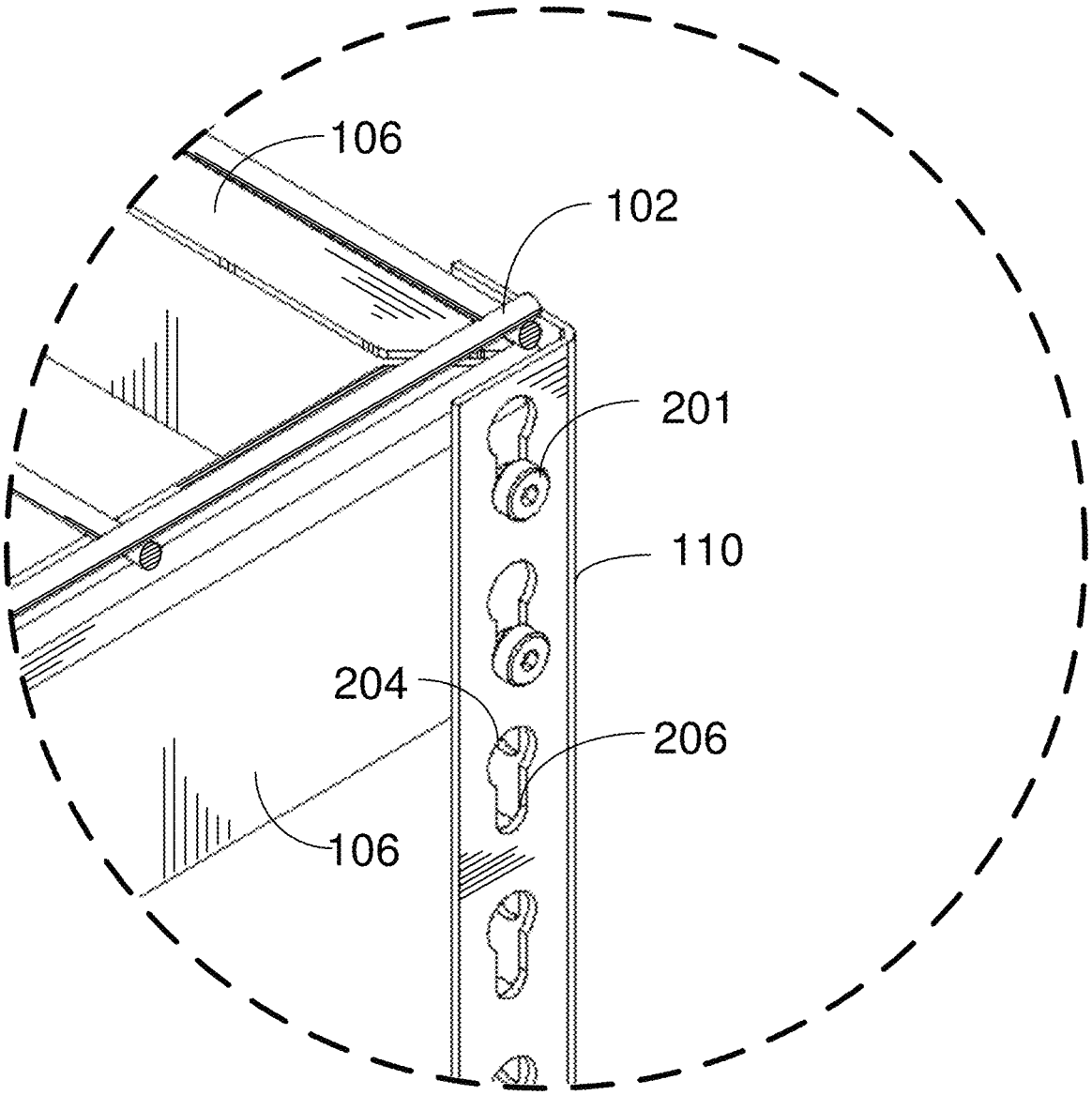
FIG. 2 is an enlarged view of a portion of FIG. 1 as indicated in the broken line circle in FIG. 1.
Figure 7A:
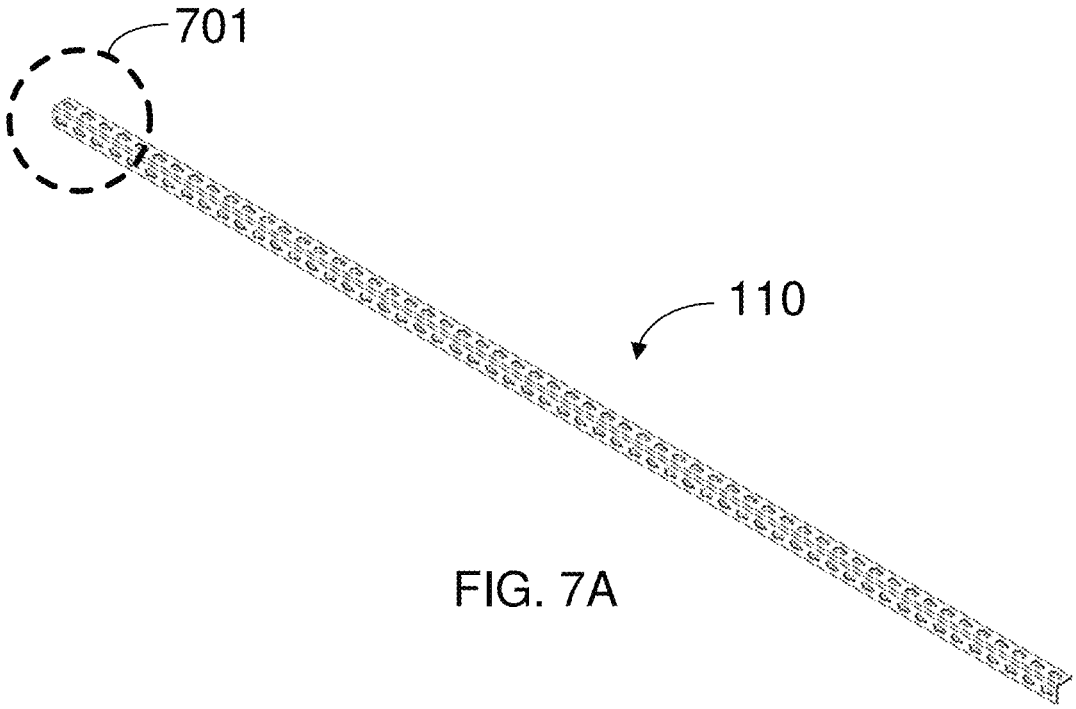
FIG. 7A is a perspective view of a vertical post in an embodiment of the invention.
Figure 7B:
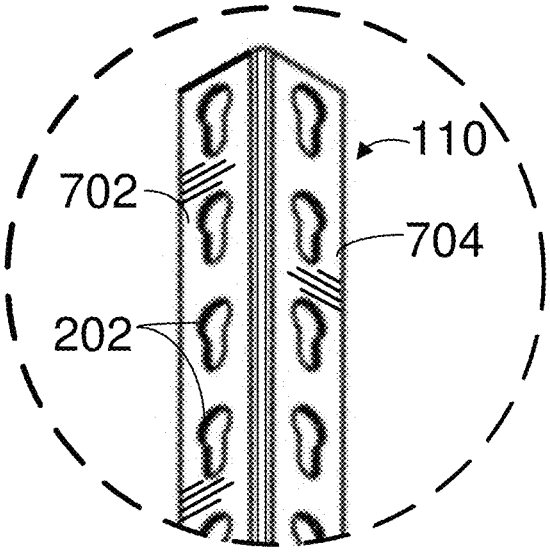
FIG. 7B is an enlarged view of the portion of a vertical post as indicated by the broken line circle in FIG. 7A, showing the key-hole shaped slots in the vertical support.

Beams 106 are attached to and supported by vertical posts 110 (as described in more detail below) at each corner of deck 102, as shown in FIG. 2 which is an enlarged view of the portion of FIG. 1 indicated by the broken line 120. Referring also to FIGS. 7A and 7B, in some embodiments, the vertical posts 110 are generally L-shaped having two flat sides 702, 704 of approximately equal width that lie perpendicular to one another, with each face including a plurality of spaced holes so that the shelves can be position at any desired height. As shown in greater detail in FIG. 7B, which is an enlarged view of the portion of FIG. 7A indicated by the broken line 701, the spaced holes in the vertical posts can be generally shaped in the manner of a keyhole with a wider upper portion 204 and a lower narrow portion 206. As described below, the keyhole-shaped openings should be sized so that the upper portion is large enough to receive the head portion of a shoulder bolt or similar fastener, while the lower narrow portion extending downward is sufficiently wide to receive the shank of the shoulder bolt or similar fastener but not large enough to allow passage of the head.

Vertical posts can be formed from steel or another appropriate material with a thickness of at least 20 gauge, such as at least 16 gauge, at least 12 gauge or at least 10 gauge. Although the vertical posts of FIG. 1 have an L-shaped cross section, vertical posts with a different cross-section shape can be used, for example a flat or rectangular cross-section. Further, vertical posts can be located at locations other than the corners of deck 102 as long as the deck is adequately supported. In some embodiments, each vertical post has at least an upper post member and a lower post member coupled together to form a longer vertical post. The overall height of vertical post 110 can then be controlled by adjusting the overlap of the upper and lower post members, which can be connected using bolts, or other means, such as interlocking slots on one post member and protrusions on the other post member.

Figure 4:
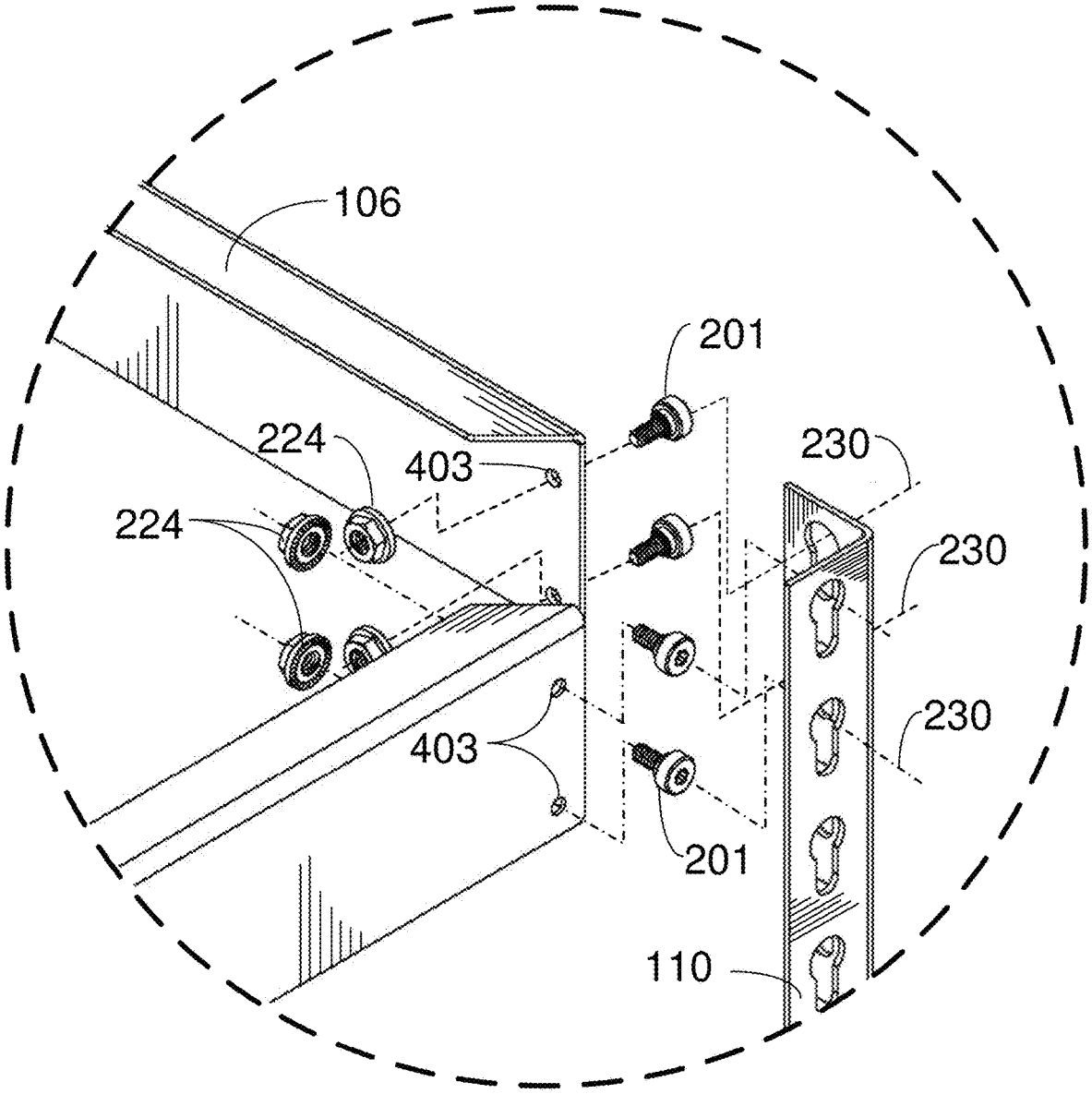
FIG. 4 is an enlarged view of a portion of FIG. 3 as indicated in the broken line circle in FIG. 3.

FIG. 4 is an enlarged view of a portion of FIG. 3 as indicated in the broken line circle 320 in FIG. 3. As discussed above, vertical post 110 is generally L-shaped with two flat faces 702, 704 that lie perpendicular to one another. Each face 702, 704 includes a plurality of vertically spaced keyhole-shaped openings 202, each having a wider upper portion 204 and a lower narrow portion 206 that are dimensioned to capture the heads of the shoulder bolts or similar fasteners discussed herein. In some embodiments the vertically spaced openings extend over the entire length of the vertical posts, which allows the heights of the shelves to be adjusted to various heights. Beams 106 are formed with mounting holes 403 at each end of the beam, which allow the beams to be attached to and supported by vertical posts 110. In the embodiment of FIG. 2, the spacing between the two mounting holes at an end of the beam is substantially the same as the vertical spacing between keyhole slots 202 on vertical post 110.

Figure 5A:
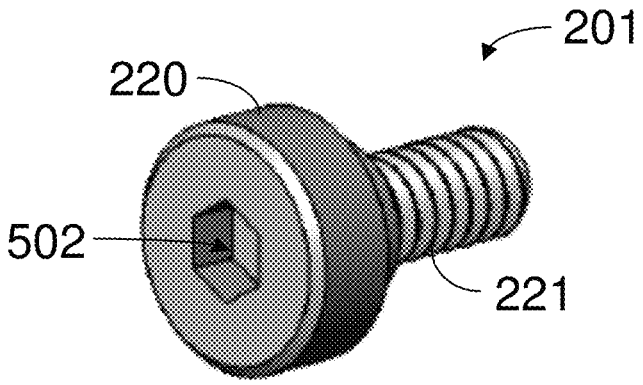
FIG. 5A is a perspective view of a shoulder bolt which can be used to mount the horizontal shelf support beams by way of the keyhole slots in the vertical posts according to an embodiment.
Figure 5B:
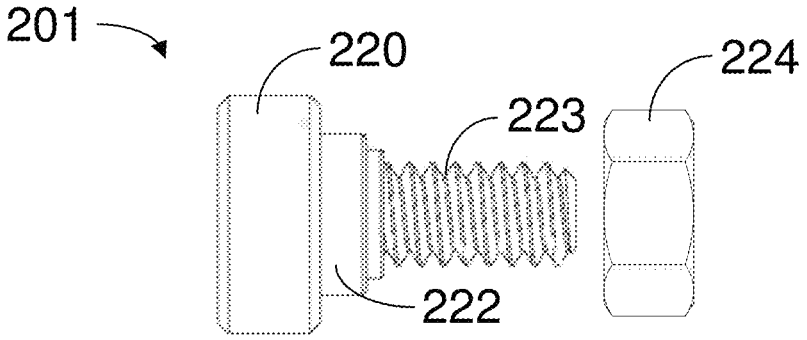
FIG. 5B is a side view of a shoulder bolt and hex nut according to an embodiment.
Figure 6A:
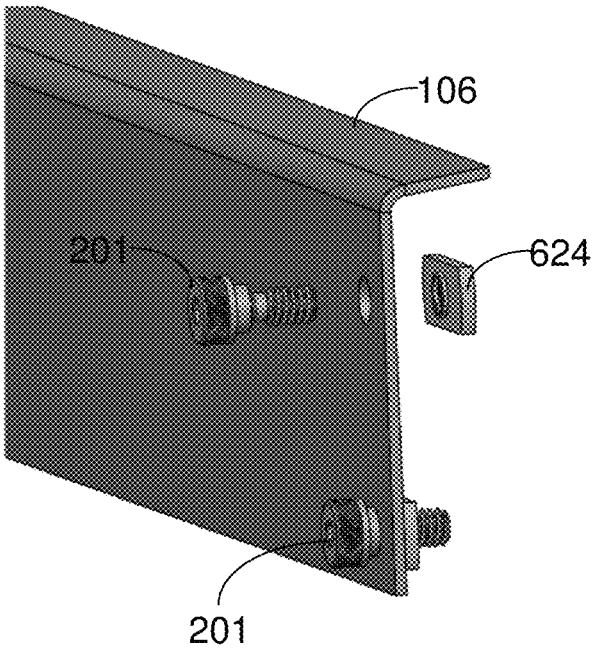
FIGS. 6A-6B show another embodiment of a shoulder bolt and nut used to attach a support beam to a vertical support according to an embodiment of the invention.
Figure 6B:
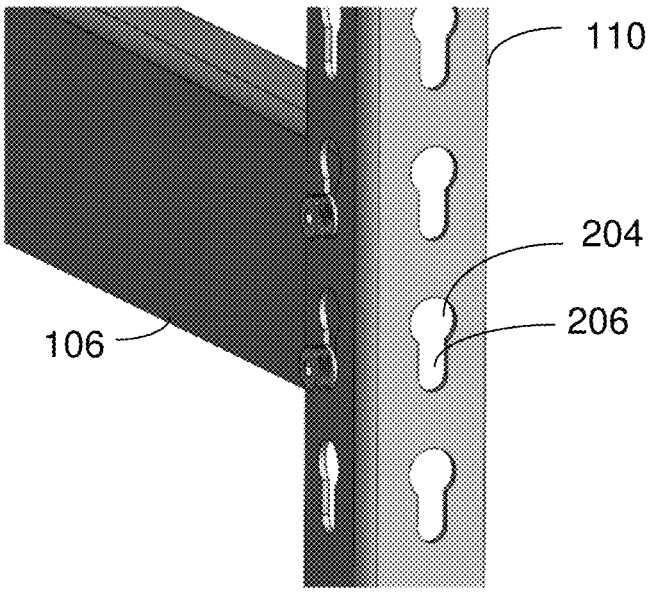

In embodiments of the invention, beams 106 can be attached to vertical posts 110 using shoulder bolts 201. Referring also to FIGS. 5A-5B, shoulder bolts 201 include a head portion 220 and a narrower shank portion 221, which has an unthreaded shoulder portion 222 and a threaded portion 223. As shown by dashed lines 230, the shank portion 221 of each shoulder bolt 201 can be inserted through one of the mounting holes 403 so that the threaded portion of the shank 221 extends to the inside of the beam 106, with the head portion 220 facing out (toward the outer face of the beam in its assembled orientation). Shoulder bolts 201 can be held in place by hex nuts 224 or other suitable attachment means (such as, for example, the square nut 624 shown in the embodiment of FIG. 6A, or other known types of nuts, clips, or pins) adapted to engage the shank portion 221 of the shoulder bolts. Nuts 224 and/or shoulder bolt heads 220 can be formed with a wrench/tool receiving surface to allow the bolts to be tightened or loosened. For example, one or both of the nuts 224 and bolt head 220 can be hex shaped so that an ordinary wrench can be used to tighten or loosen the bolt. Other types of wrench/tool receiving surfaces could be used such as the hexagonal socket 502 in the bolt head shown in FIG. 5A, which allows the bolt to be tightened or loosened using an appropriately sized hex key.

Once shoulder bolts 201 have been mounted onto the end of beam 106, the head portions 220 of the two shoulder bolts 201 can be inserted into the wide portions 204 of corresponding keyhole slots on vertical post 110 (depending on the desired vertical position of the shelf or deck to be supported). The beam can then be push downward with respect to the vertical post and keyhole slot so that the narrower unthreaded shoulder portion of the bolt will slide into the lower portion 206 of the keyhole slot. Because the slots are dimensioned so that the head portions are too large to fit through the lower portion of the keyhole slots, the beams and vertical posts can be held securely together. In order to detach the beams from the posts, the beam must be lifted up so that the bolt heads can be withdrawn through the wider upper portions of the keyhole slots.

Significantly, the shoulder bolts in embodiments of the invention are not permanently attached to the beams like the rivets of known boltless shelving units. This provides a number of significant advantages. By only loosely tightening the shoulder bolts and nuts when they are initially mounted onto the beams 106, the heads and shoulder portions of the bolts can easily slide into the keyhole slots without the application of any significant force (such as by using a hammer to seat the bolts in the keyhole slots). Then once the beams and vertical posts are assembled by sliding the shoulder bolt heads (mounted onto the beams) into the keyhole slots on the vertical supports, a wrench or other tool can be used to tighten the shoulder bolts 201 in order to apply compressive force to the connected portions of the beams and vertical supports to lock those connections in place. In order to disassemble shelving according to embodiments of the invention, shoulder bolts 201 can be loosened using the same wrench or other tool so that the bolt heads can be easily removed from the keyhole slots. Shoulder bolts according to embodiments of the invention can also be easily removed from the beams and replaced in the event that one or more bolts becomes damaged or otherwise unusable.

In some embodiments, the length of the unthreaded shoulder portion 222 is approximately equal to the total thickness of the mounting surface of beam 106 and the thickness of the vertical support post. In other embodiments, the length of the unthreaded shoulder portion 222 is shorter than the total thickness of the mounting surface of beam 106 and the thickness of the vertical support post, which allows for the application of a very high degree of compressive force to hold the beams in place.

Figure 10:
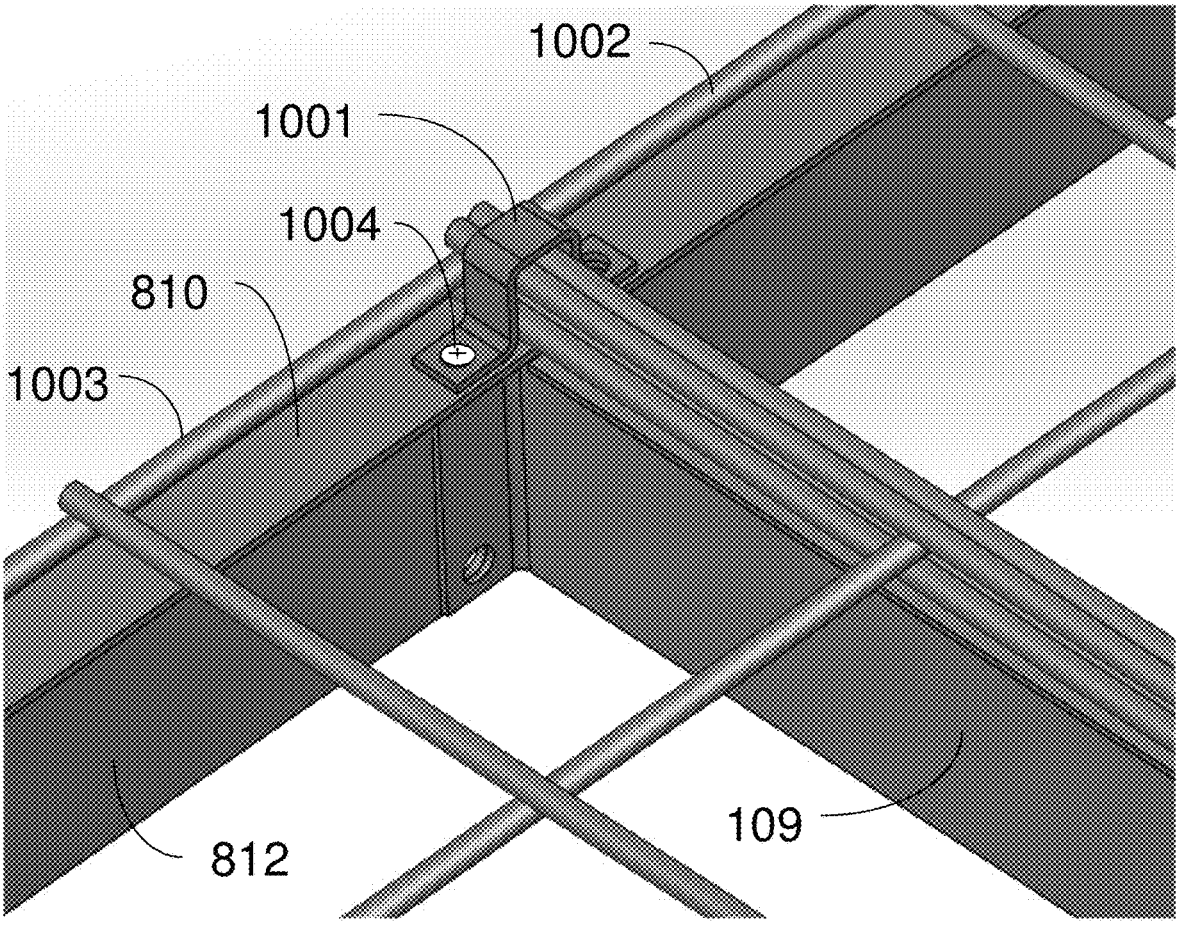
FIG. 10 is a view of a clip used to hold two deck panels in place on the support beams according to an embodiment.

In some embodiments, multiple welded wire deck sections or panels can be combined to create a larger wire deck. While generally rectangular decks have been described, the invention is not limited to any particular shape of deck. As shown in the embodiment of FIG. 10, a clip 1001 that can be used to hold two deck panels 1002, 1003 in place on the support beams. Clip 1001 can be placed over the end wires of adjacent wire decks and attached to the horizontal portion 810 of the support beam using any suitable type of fastener 1004 such as typical screw or bolt and nut fasteners. In some embodiments, the joint between the two adjacent deck panels 1002, 1003 can be supported by a center support 109 for increased strength.

The invention described herein has broad applicability and can provide many benefits as described and shown in the examples above. The embodiments will vary greatly depending upon the specific application. In some embodiments, for example, the arrangement of shoulder bolts and keyhole slots could be reversed so that the keyhole slots are formed on the horizontal beams and the shoulder bolts are attached to the vertical corner posts. Not every embodiment will provide all the benefits and meet all the objectives that are achievable by the invention.

In the discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale. As used herein, the words "right," "left," "lower," "upper," "bottom," "horizontal," "vertical," "outer," "inner," and the like designate directions in the drawings to which reference is made. These terms are used for convenience only and are not limiting.

The scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. The figures described herein are generally schematic and do not necessarily portray the embodiments of the invention in proper proportion or scale.

What is claimed is:

1. A shelving unit comprising:

a deck for storing items;

a frame for supporting the deck along at least a portion of a perimeter of the deck, the frame being formed by two or more beams, each of the beams including at least one opening at each end of the beam for receiving a fastener; fasteners for the opening at the end of each of the beams forming the frame, the fasteners comprising shoulder bolts, each shoulder bolt having a head and a shank, with the shank having a threaded portion distal to the head and an unthreaded portion proximal to the head, the unthreaded portion having a substantially smooth surface; and multiple vertical posts for supporting the beams, each of the multiple vertical posts including a plurality of generally keyhole shaped openings;

wherein the fasteners are directly attached to the beams by inserting the fastener shank through the openings at the end of the beam and tightening a nut on the threaded portion of the shank; and wherein the beams are attached to the vertical posts by inserting the shoulder bolt head into one of the keyhole shaped openings in the vertical posts.

2. The shelving unit of claim 1 in which the head has a lateral dimension that is narrower than the lateral dimension of the shank.

3. The shelving unit of claim 2 in which the generally keyhole shaped openings have a wider upper portion and a narrower lower portion extending downward from the upper portion.

4. The shelving unit of claim 2 in which the generally keyhole shaped openings have a larger upper opening sized so that it is large enough to receive the head of said shoulder bolt and a narrower lower opening extending downward from the upper opening, said lower opening being sufficiently wide to receive the shank of the shoulder bolt but not large enough to allow passage of the head of the shoulder bolt.

5. The shelving unit of claim 1 in which the head of the shoulder bolt is formed with a tool receiving surface so that said bolt can be further tightened after the frame is attached to the vertical posts to apply compressive force to hold the frame in place.

6. The shelving unit of claim 1 in which the head of the shoulder bolt is formed with a hexagonal socket so that the shoulder bolt can be tightened using a hex key wrench.

7. The shelving unit of claim 1 in which the length of the unthreaded portion is approximately equal to the combined thickness of the beam and the vertical posts.

8. The shelving unit of claim 1 in which the length of the unthreaded portion is shorter than the combined thickness of the beam and the vertical post.

9. The shelving unit of claim 1 in which the deck comprises a welded wire mesh.

10. The shelving unit of claim 1 in which the deck comprises two or more deck panels mounted side-by-side.

11. The shelving unit of claim 1 in which the frame for supporting the deck comprises two longitudinal beams and two transverse beams forming a rectangular frame supporting the deck along an entire perimeter of the deck.

12. The shelving unit of claim 1, in which the frame for supporting the deck comprises one or more center support beams extending across the center of the deck between two horizontal support beams.

13. The shelving unit of claim 1, in which the beams have a generally L-shaped cross section with a vertical portion and a horizontal portion, said horizontal portion serving to support the deck.

14. A shelving unit comprising:

a deck for storing items;

a frame for supporting the deck along at least a portion of a perimeter of the deck, the frame being formed by two or more horizontal support beams; and multiple vertical posts for supporting the beams;

wherein the frame is attached to each of the multiple vertical posts by way of shoulder bolts at each end of each of the two or more beams, the shoulder bolts having a head and a narrower shank, with the shank having a threaded portion distal to the head and an unthreaded portion proximal to the head, the unthreaded portion having a substantially smooth surface, each of the shoulder bolts first being attached to the beams by a nut threaded onto the threaded portion of the shank so that the head and the unthreaded portion of the shank extend from an outer face of the beam so that the head then can be inserted into one of a plurality of keyhole shaped opening in the vertical posts, each opening having a wider upper portion and a narrower lower portion, said keyhole shaped opening sized so that the upper portion is large enough to receive a head portion of one of the shoulder bolts, while the lower narrow portion, which is extending downward is sufficiently wide to receive the shank of the shoulder bolt or similar fastener but not large enough to allow passage of the head.

15. The shelving unit of claim 14 in which the head of the shoulder bolt is formed with a tool receiving surface so that said bolt can be further tightened after the frame is attached to the vertical posts to apply compressive force to hold the frame in place.

16. The shelving unit of claim 14 in which the length of the unthreaded portion of the shank of the shoulder bolts is approximately equal to the combined thickness of the beam and the vertical posts.

17. The shelving unit of claim 14 in which the deck comprises a welded wire mesh.

18. The shelving unit of claim 14 in which the frame for supporting the deck comprises two longitudinal beams and two transverse beams forming a rectangular frame supporting the deck along an entire perimeter of the deck.

19. A shelving unit comprising:

a plurality of decks for storing items;

a frame for supporting each of the decks along at least a portion of a perimeter of the deck, the frame being formed by two or more horizontal support beams; one or more fasteners that can first be attached at each end of the two or more horizontal support beams, the fasteners comprising shoulder bolts having a head and a narrower shank, with the shank having a threaded portion distal to the head and an unthreaded portion proximal to the head, the unthreaded portion having a substantially smooth surface, each of the shoulder bolts capable of being attached by a nut threaded onto the threaded portion of the shank so that the head and the unthreaded portion of the shank extend from an outer face of the beam; and multiple vertical posts for supporting the beams, each vertical post having a plurality of vertically spaced keyhole-shaped openings with each keyhole-shaped opening having a wider upper portion and a narrower lower portion, said keyhole shaped opening sized so that the upper portion is large enough to receive a head portion of one of the shoulder bolts, while the lower narrow portion, which is extending downward, is sufficiently wide to receive the shank of the shoulder bolts but not large enough to allow passage of the head portion of said shoulder bolts wherein each frame can be attached to the vertical posts by way of the shoulder bolts first being attached at each end of each of the two or more horizontal support beams, so that the head of each shoulder bolt can then be inserted into the wider upper portion of one of the plurality of keyhole-shaped openings in one of the vertical posts and the frame then pushed downwardly so that the shank of the shoulder bolt slides into the lower narrower portion of the keyhole-shaped opening.

* * * * *